United States Patent [19]

Sweeney

[11] Patent Number: 4,804,891

[45] Date of Patent: Feb. 14, 1989

[54] PHOTOMULTIPLIER TUBE WITH GAIN CONTROL

[75] Inventor: Harold E. Sweeney, Menlo Park, Calif.

[73] Assignee: GTE Government Systems Corporation, Stamford, Conn.

[21] Appl. No.: 109,339

[22] Filed: Oct. 16, 1987

[51] Int. Cl.[4] ..... H01J 29/52; H01J 40/14

[52] U.S. Cl. ..... 315/383; 250/207; 250/214 A; 250/214 AL

[58] Field of Search ..... 250/207, 214 A, 214 AL; 315/383

[56] References Cited

U.S. PATENT DOCUMENTS

| | | | |
|---|---|---|---|
| 3,321,629 | 5/1967 | Hobrough | 250/207 |
| 3,465,157 | 9/1969 | Martens | 250/207 |
| 3,943,458 | 3/1976 | Cohn | 250/207 |
| 4,367,404 | 1/1983 | Kaye | 250/207 |
| 4,590,368 | 5/1986 | Govaert | 250/214 AG |
| 4,649,269 | 3/1987 | Persyk | 250/207 |

*Primary Examiner*—Theodore M. Blum
*Assistant Examiner*—David Cain
*Attorney, Agent, or Firm*—Douglas M. Gilbert; John F. Lawler

[57] ABSTRACT

Improved gain control in a photomultiplier tube having a plurality of dynode stages is achieved through manual or automatic change of the bias voltage on at least one of the several dynodes between the anode and cathode of the tube. By such means, maximum tube gain change is obtained with a minimum of bias voltage swing.

9 Claims, 2 Drawing Sheets

PHOTOMULTIPLIER TUBE WITH GAIN CONTROL

The Government has rights in this invention pursuant to Contract No. N66001-86-C-0050 awarded by the Department of the Navy.

BACKGROUND OF THE INVENTION

1. Field of the Invention

This invention relates to photomultiplier tubes and more particularly to such a tube with improved means for controlling the gain thereof.

2. Description of the Prior Art

A photomultiplier tube (PMT) is one of the most, if not the most, sensitive optical detector for operating in the visible and ultraviolet spectrum. A complete description of the theory, design and application of the photomultiplier tube is given in *Photomultiplier Handbook* published by RCA Corporation (PMT-62, 1980). In certain applications with widely varying background illumination, however, it is necessary to vary the gain to remain within the anode current rating of the PMT. The conventional approach to achieve this result is to reduce the bias voltage of the entire dynode resistive divider. The reduced voltage is reflected as a reduced voltage on each stage of the chain and the overall gain is thereby reduced.

The effect of this conventional approach is that reduction of gain of the first dynode stage adjacent to the cathode tends to produce a degraded noise figure for the PMT because noise associated with subsequent stage contributes more significantly to the total noise. While the gain of the first stage may be kept constant by use of a voltage regulator diode, such as a Zener diode, the diode itself often introduces undesirable noise. Another disadvantage is that a wide swing in gain requires a wide voltage swing. Typically, a conventional PMT may require a 700 volt swing to effect a 3 decade gain change.

This invention is directed toward dynode bias circuit which overcomes these disadvantages.

OBJECTS AND SUMMARY OF THE INVENTION

A general object of the invention is the provision of a PMT with a dynode bias circuit which permits a wide variation in gain with minimum voltage change.

A further object is the provision of a PMT in which the gain is automatically limited under high background illumination levels.

These and other objects of the invention are achieved with a PMT in which one or more dynodes are biased independently of the other dynodes and are moved selectively or automatically out of their normal bias potentials relative to the fixed bias potentials of the neighboring dynodes.

DESCRIPTION OF THE PREFERRED EMBODIMENTS

Figure 1:
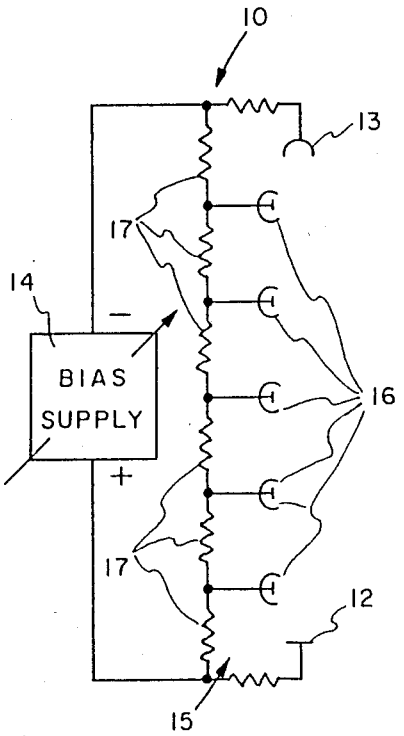
FIG. 1 PRIOR ART
FIG. 1 is a schematic circuit diagram of a conventional PMT bias network.

Referring now to the drawings, a conventional PMT 10 is shown in FIG. 1 and comprises an anode 12 spaced from a photocathode 13, hereafter called cathode, and both connected to a bias supply 14 (electrical power service), the cathode being responsive to ambient light incident thereon to produce a current flow between cathode 13 and anode 12 proportional to the intensity of the incident light. A plurality of series-connected dynode stages 15 is connected to bias supply 14 in parallel with anode 12 and cathode 13, each stage comprising a dynode 16 and an interstage resistance 17; the negative dynode voltages progressively increase between the cathode and anode voltages. By way of example, five dynode stages are shown in the drawing. Dynodes 16 are aligned in a row adjacent and parallel to and between anode 12 and cathode 13 as shown. The conventional technique for varying the gain of PMT 10 to compensate for changes in ambient light intensity is to vary the voltage across the entire dynode resistive chain by adjusting the output of bias supply 14 as suggested by the arrow. Reduction of gain of the stage adjacent to cathode 13 can produce undesirable noise that adversely affects performance of the PMT.

Figure 2:
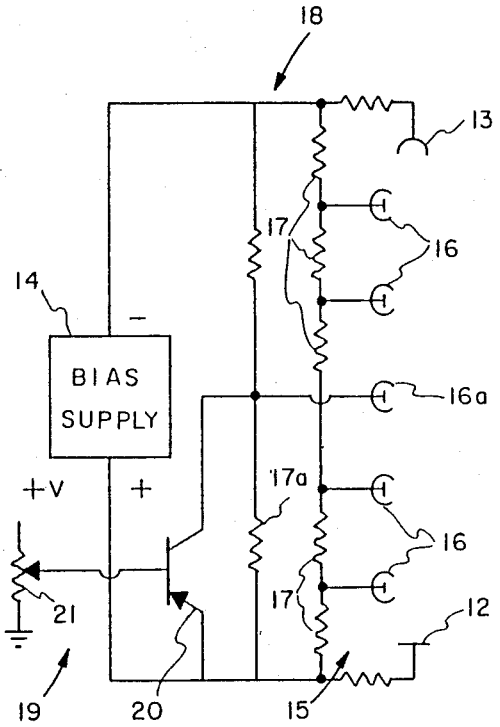
FIG. 2 is a similar circuit diagram of a PMT embodying this invention.

In accordance with one embodiment of this invention, gain control of PMT 18, see FIG. 2, is achieved by adjustment of the bias voltage of one of the plurality of dynodes 16 relative to the fixed bias potentials of the remaining dynodes in the dynode chain. As shown in the drawing, the bias voltage of one dynode 16a spaced between anode 12 and cathode 13 is derived from bias resistor 17a connected across bias supply 14 in parallel with the bias resistors 17 of the other dynodes 16; in the drawings, like reference characters indicate like parts. As in FIG. 1, five dynode stages are shown in FIG. 2 and dynode 16*a* is the third in the chain. Variation of the bias voltage across dynode 16*a* is selectively provided by control means 19, shown by way of example as a transistor 20 connected across resistor 17*a* and a potentiometer 21 connecting the base of transistor 20 to a bias voltage source +V. By adjustment of the output of potentiometer 21, the bias voltage of dynode 16*a* is varied independently of the fixed bias potential on the other diodes 16. In other words, the adjustable biasing of dynode 16*a* is isolated from that of the other dynodes.

Figure 3:
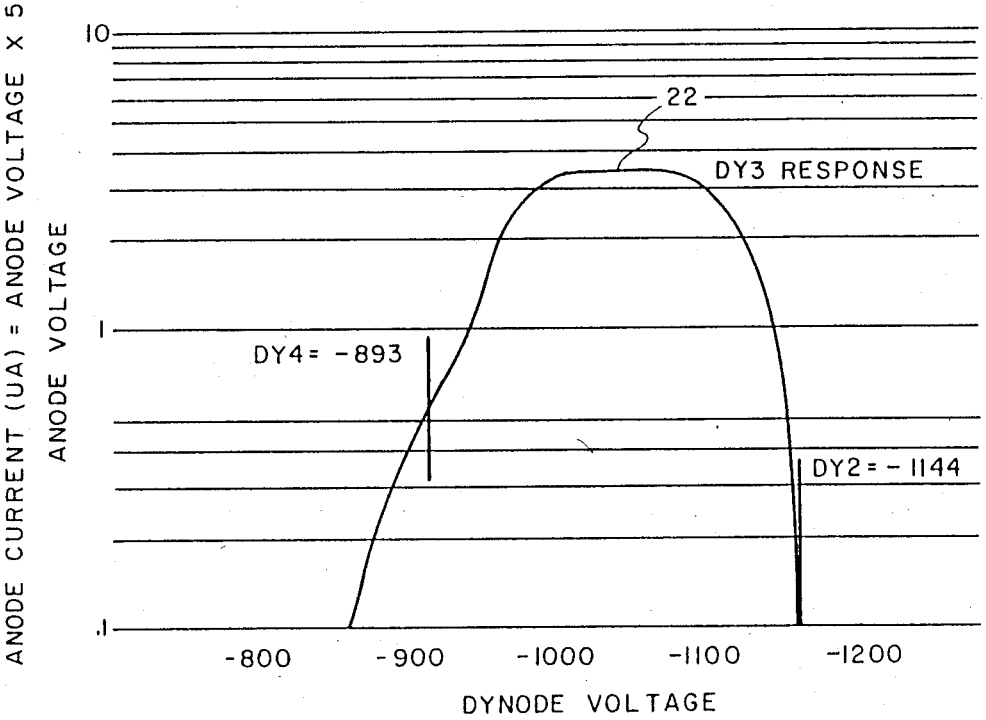
FIG. 3 is a plot of variation of anode current with bias voltage of one isolated dynode in accordance with the invention.

The variations of PMT anode current with change of bias voltage of dynode 16*a* is indicated by curve 22 shown in FIG. 3 wherein DY2, DY3 and DY4 indicate the second, third and fourth dynodes in the chain. It will be noted that PMT gain (value of anode current) is maximum and fairly constant for DY 3 bias voltages in the mid portion between the bias voltages of DY2 and DY4 and that such gain falls off sharply as DY 3 bias voltages approach those of the adjacent dynodes. This characteristic is useful in providing automatic gain control of the PMT as explained hereafter in the embodiments of FIGS. 5 and 6. In practice a gain change by a factor of 30 has been effected using the single dynode of FIG. 2 and a bias voltage change of less than 100 volts. Attainment of such performance is advantageous because control may be effected by use of a single transistor with a lower voltage rating which is more readily available, more economical and generally more reliable.

Figure 4:
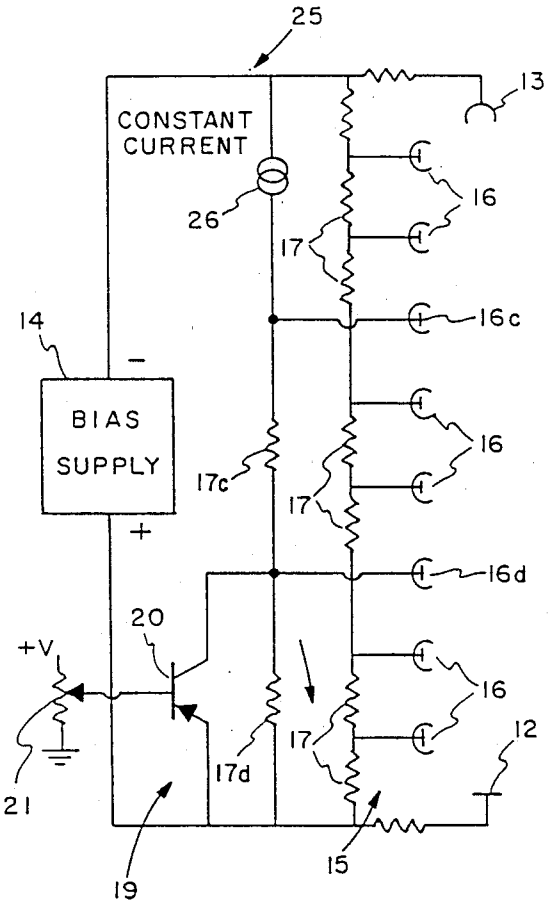
FIG. 4 is a circuit diagram similar to FIG. 2 showing another embodiment of the invention with two bias-isolated dynodes connected to a selective bias control.

FIG. 4 shows another embodiment of the invention in which PMT 25 has a plurality of dynode stages 15, eight as shown, having dynodes 16 and interstage resistors 17; like reference characters indicate like parts on the drawings. In this embodiment two dynodes 16*c* and 16*d* are spaced apart with at least two fixed-bias dynodes between them and have bias resistances 17*c* and 17*d*, respectively, connected across bias supply 14 in parallel with the bias resistances 17 of the remaining dynodes 16. A constant current source 26 such as a current regular diode or a suitably biased transistor circuit is connected in series with resistances 17*c* and 17*d*. The bias voltage of dynode 16*d* is variably controlled by control means 19 as described above. Constant current source 26 maintains a constant voltage across resistor 17*c* and thereby maintains a constant bias voltage difference between dynodes 16*c* and 16*d*. This maintains the same bias voltage change on each of dynodes 16*c* and 16*d* with variations of bias voltage by control 19. Since the two dynodes 16*c* and 16*d* are active independently of the other dynodes, a wide control range is effected with a modest control voltage change. By way of example, the gain control range of 30 for the PMT of the FIG. 2 embodiment is extended to $30^2=900$ for the PMT of the FIG. 4 embodiment with identical bias voltage change.

Figure 5:
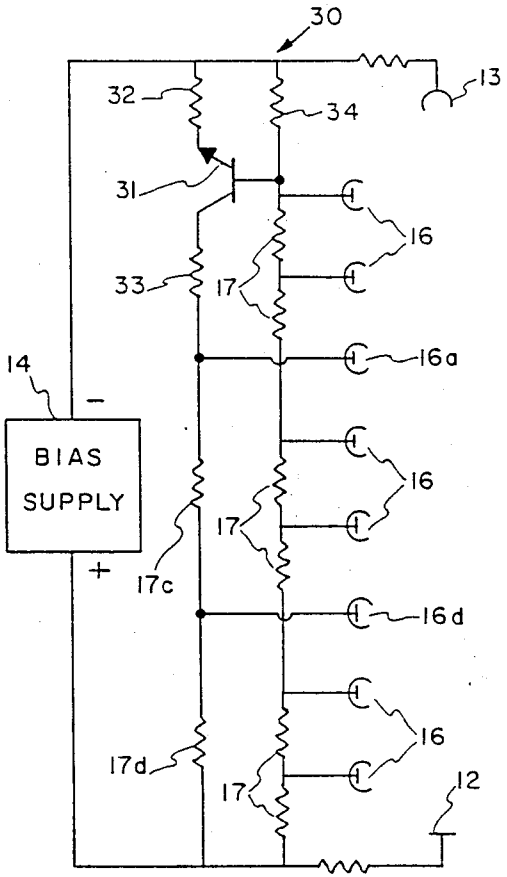
FIG. 5 is a similar circuit diagram showing still another embodiment of the invention showing an automatic anode current limiting control.

Another variation of dynode bias voltage control is shown in FIG. 5 wherein means are provided for automatically limiting the anode current of a PMT 30 under conditions of high ambient light. As shown, the variable bias control means 19 of PMT 25 in the FIG. 4 embodiment is omitted from PMT 30 and the constant current source 26 of PMT 25 is replaced by a current transfer transistor 31, also known as a current mirror. Transistor 31 has an emitter connected to one terminal of bias supply 14 through resistor 32 and a collector connected through resistor 33 to bias resistor 17*c* of dynode 16*c*. In other respects, PMT 30 is the same as PMT 25. In operation, as anode current increases with exposure of PMT 30 to increased ambient light intensity, most of this current flows through resistor 34. This biases transistor 31 to draw more current in resistors 17*c* and 17*d* which decreases the voltage (more negative) on dynodes 16*c* and 16d. If the bias potentials on the dynodes of PMT 30 are initially selected to permit operation toward the right side of curve 22 in FIG. 3, the overall gain of PMT 30 reduces under these conditions. This results in a self-limiting effect which maintains the anode current within safe operating limits. Since the circuit does not respond to fast (i.e., $<100$'s of ns) pulses, signal pulses can appear at the anode.

Figure 6:
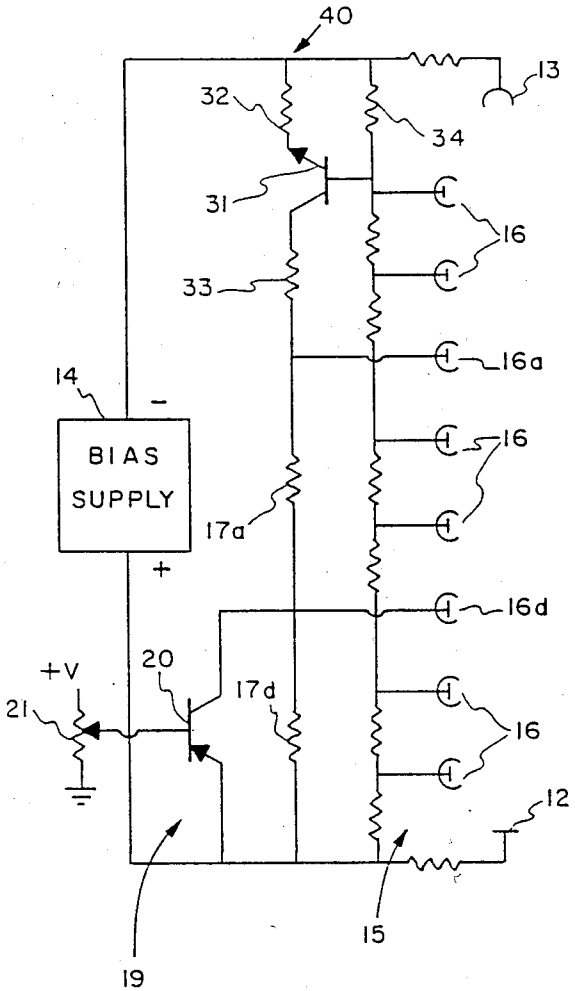
FIG. 6 is a similar circuit diagram showing a further embodiment of the invention which combines the features of the embodiments of FIGS. 2 and 5.

FIG. 6 shows a PMT 40 which combines the structure and features of PMT 30 (FIG. 5) with the variable gain structure of PMT 25 (FIG. 4) (transistor 31 acts as a constant current source at low light levels) to achieve both variable control and self-limiting action; like reference characters indicate like parts on the drawings. Bias control is attainable at any illumination level while the self-limiting effect maintains operation within safe anode current limits.

What is claimed is:

1. In a photomultiplier tube having an anode and a cathode spaced from each other and connected to a power supply, said cathode being responsive to the intensity of ambient light incident thereon to produce a current flow between said cathode and said anode proportional to said intensity, said tube having a first plurality of dynode stages positioned between said anode and said cathode and electrically connected to said power supply, an improved gain control means consisting of:

first interstage resistance means for biasing said first plurality of dynodes with fixed dynode voltages progressively increasing between said cathode and said anode voltages;

a second plurality of dynodes structurally connected interstitially with said first plurality of dynodes;

control means connected in parallel with said first interstage resistance means for biasing said second plurality of dynodes with voltages progressively increasing between said cathode and said anode voltages, said control means adapted to vary the bias voltages of said second plurality of dynodes independently of the bias voltage of said first plurality of dynodes to maximize said photomultiplier tube gain with a minimum variation of bias voltage on said second plurality of dynodes.

2. The photomultiplier tube according to claim 1 wherein said control means varies the bias voltages of said second plurality of dynodes while maintaining a constant voltage differential between each of said second plurality of dynodes.

3. The photomultiplier tube according to claim 2 in which said control means further comprises:

second interstage resistance means for biasing said second plurality of dynodes; and a constant current source in series with said second interstage resistance means.

4. In a photomultiplier tube having an anode and a cathode spaced from each other and connected to a power supply, said cathode being responsive to the intensity of ambient light incident thereon to produce a current flow between said cathode and said anode proportional to said intensity, said tube having a plurality of first dynode stages positioned between said anode and said cathode and electrically connected to said power supply, each of said stages comprising a dynode electrode and interstage resistance means with dynode voltages progressively increasing between said cathode and said anode, the improvement consisting of:

second and third dynode stages connected in series, each of said stages comprising a dynode electrode and second interstage resistance means; and current transfer means connected in series with said second and third dynode stages, the series combination of said transfer means and said second and third dynode stages being operatively connected in parallel with said first dynode stages;

said transfer means being responsive to changes in said current flow between the anode and cathode for proportionally reducing the bias voltage on said second and third dynodes automatically limiting said current flow to a predetermined range.

5. In a photomultiplier tube having an anode and a cathode spaced from each other and connected to a power supply, said cathode being responsive to the intensity of ambient light incident thereon to produce a proportional anode current, said tube having a plurality of dynodes positioned between said anode and said cathode and electrically connected to said power supply, the improvement for limiting said peak anode current consisting of:

interstage resistance means for connecting in series all but two of said dynodes, for biasing all but said two dynodes with voltages progressively increasing between said cathode and said anode, and for producing a maximum tube gain;

control means for sensing said anode current and for selectively biasing said two other dynodes such that, a. for anode currents above a predetermined amount, said biasing reduces said tube gain and, b. for anode currents below a predetermined amount, said biasing progressively increases between said cathode and said anode for maximum tube gain.

6. The photomultiplier tube according to claim 5 in which said control means is selectively adjustable.

7. The photomultiplier tube according to claim 5 in which said control means is automatically operable in response to the magnitude of current flow between said anode and said cathode.

8. The photomultiplier tube according to claim 5 in which said control means is both selectively adjustable and automatically operable in response to the magnitude of current flow between said anode and said cathode.

9. The photomultiplier tube according to claim 8 in which said two other dynode stages are non-adjacent to each other.

* * * * *